US008113454B2

(12) United States Patent
Lin

(10) Patent No.: US 8,113,454 B2
(45) Date of Patent: Feb. 14, 2012

(54) PAPER SHREDDING ROLLER ASSEMBLY

(76) Inventor: Ching-Piao Lin, Hsin-Den (TW)

( * ) Notice: Subject to any disclaimer, the term of this patent is extended or adjusted under 35 U.S.C. 154(b) by 82 days.

(21) Appl. No.: 12/801,017

(22) Filed: May 17, 2010

(65) Prior Publication Data

US 2011/0108650 A1 May 12, 2011

(30) Foreign Application Priority Data

Nov. 6, 2009 (CN) ..... 2009 2 0238636 U
Dec. 9, 2009 (CN) ..... 2009 2 0264470 U

(51) Int. Cl.
*B02C 7/04* (2006.01)
*B02C 13/20* (2006.01)

(52) U.S. Cl. ..... 241/236; 241/292.1

(58) Field of Classification Search ..... 241/291, 241/292.1, 236
See application file for complete search history.

(56) References Cited

U.S. PATENT DOCUMENTS 4,860,963 A * 8/1989 Goldhammer et al. ..... 241/236
5,328,107 A * 7/1994 Tsai ..... 241/295
5,560,552 A * 10/1996 Powell et al. ..... 241/100
2004/0140383 A1* 7/2004 Chang ..... 241/236
2004/0262436 A1* 12/2004 Lo ..... 241/236
2006/0049291 A1* 3/2006 Rajewski ..... 241/167
2007/0034724 A1* 2/2007 Wang ..... 241/236
2008/0093491 A1* 4/2008 Abramson et al. ..... 241/236

* cited by examiner

*Primary Examiner* — Bena Miller

(57) ABSTRACT

A paper shredding roller assembly comprises of a left roller (1), a right roller (2) juxtaposed to said left roller (1), a plurality of left and right circular knives (3, 4) are attached axially to said left and right roller (1, 2) in a spiral fashion, and spaced with each other by a predetermined distance (H). Pluralities of left cutting tips (31) are disposed around a circumference of the left circular knife (3) and a plurality of right cutting tips (41) are disposed around a circumference of the right circular knife (4). The paper shredding roller assembly is characterized in that: each left circular knife (3) comprises of a plurality of sloping cutting edges (5) disposed around the circumference thereof, corresponding with the right cutting tips (41); and each right circular knife (4) comprises of a plurality of sloping cutting edges (5) disposed around the circumference thereof, corresponding with the left cutting tips (31).

7 Claims, 4 Drawing Sheets

Prior Art

PAPER SHREDDING ROLLER ASSEMBLY

FIELD OF THE INVENTION

The present invention relates to a paper shredding roller assembly for a paper shredding machine.

DESCRIPTION OF PRIOR ART

A conventional paper shredding roller is shown in FIG. 1. A conventional paper shredding roller unit (8) composes of a first roller (81) and a second roller (82). The first and second roller (81, 82) is engaged with a set of first and second circular blades (83, 84) respectively and each first and second circular blade (83, 84) has a first and second cutting edge (831, 841) spacing by an interval (H). When said unit (8) is functioning, both first and second rollers (81, 82) rotate in opposite directions (one clockwise and another counterclockwise), dragging paper into the unit (8) and cutting it into stripes. The rollers (81, 82) and circular blade sets (83, 84) can also be manufactured integrally for improving the strength of the roller unit (8).

However, paper stripes can be easily reassembled, allowing sensitive documents can be read by those who are interested in. To prevent confidential paper from being reassembled and used for fraud or identity theft, cutting points (85) are added onto the first and second cutting edges (831, 841). As the rollers (81, 82) rotate, the cutting points (85) and the cutting edges (831, 841) are intercrossing with each other and cutting paper stripes in much smaller pieces.

Although the cutting points (85) are designed to lower the risk of highly confidential document being collected and reassembled, the result is less than expected. Referring to FIG. 1, when a cutting point (85) of the second cutting edge (841) intercrosses with the first cutting edge (831), the cutting angle (A) is an acute angle, which decreases the cutting force of the cutting point (85). The insufficient cutting force can cause following drawbacks:

1. Paper stripes are merely being cut into smaller pieces.
2. To ensure paper being cut into pieces, high power motor is required, which generates unnecessary waste.
3. Paper stripes which can't be cut successfully are easily wrinkled and clogged between the rollers, jamming the shredding roller unit and damaging the circular blades.

Therefore, to provide a shredding roller unit which can shred paper efficiently and avoid damage of the cutting points have become the objectives of the present invention.

SUMMARY OF THE INVENTION

To achieve above-mentioned objectives, a paper shredding roller assembly comprises of a left roller (1), a right roller (2) juxtaposed to each other, a plurality of left circular knives (3) are attached axially to said left roller (1) in a spiral fashion, and spaced with each other by a predetermined distance (H), and a plurality of right circular knives (4) are attached axially to said right roller (2) in a spiral fashion, and spaced with each other by a predetermined distance (H) and a plurality of left cutting tips (31) is disposed around a circumference of the left circular knife (3). Pluralities of right cutting tips (41) are disposed around a circumference of the right circular knife (4). The claimed paper shredding roller assembly is characterized in that: each left circular knife (3) comprises of a plurality of sloping cutting edges (5) disposed around the circumference of said left circular knife (3), corresponding with the right cutting tips (41); and each right circular knife (4) comprises of a plurality of sloping cutting edges (5) disposed around the circumference of the right circular knife (4), corresponding with the left cutting tips (31).

Two different types of circular knives can be utilized for the present invention. For the first type, pluralities of triangular projecting members (32, 42) are provided respectively around the surface of the left and right circular knife (3, 4), and each projecting member (32, 42) has a said cutting edge (5) set on a lateral side thereof. As for the second type, pluralities of cutting grooves (33, 43) and recessed portions (6) are provided around the circumference of the left and right circular knife (3, 4), and each cutting groove (33, 43) has a said cutting edge (5) set on a lateral side thereof.

When both rollers (1, 2) placed in function, the cutting tips (31, 41) of each roller slide against the sloping cutting edges (5) of another roller, increasing the cutting angle (A) approximately to a perpendicular angle, which can cut the paper more efficiently.

DETAILED DESCRIPTION OF PREFERRED EMBODIMENTS

Preferred embodiments of the present invention will be described via detailed illustration referring to the appended drawings.

First Embodiment

Figure 1:
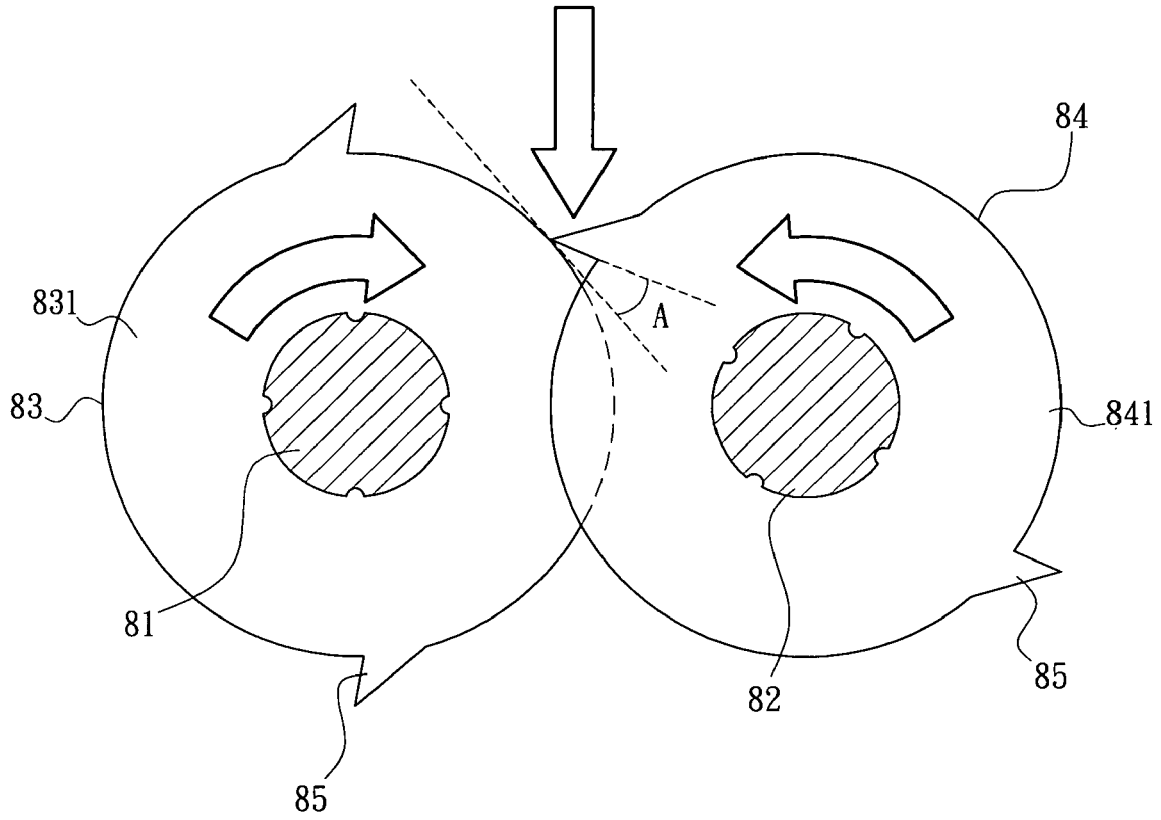
FIG. 1 is an illustrative view of a conventional paper shredding roller set.
Figure 2:
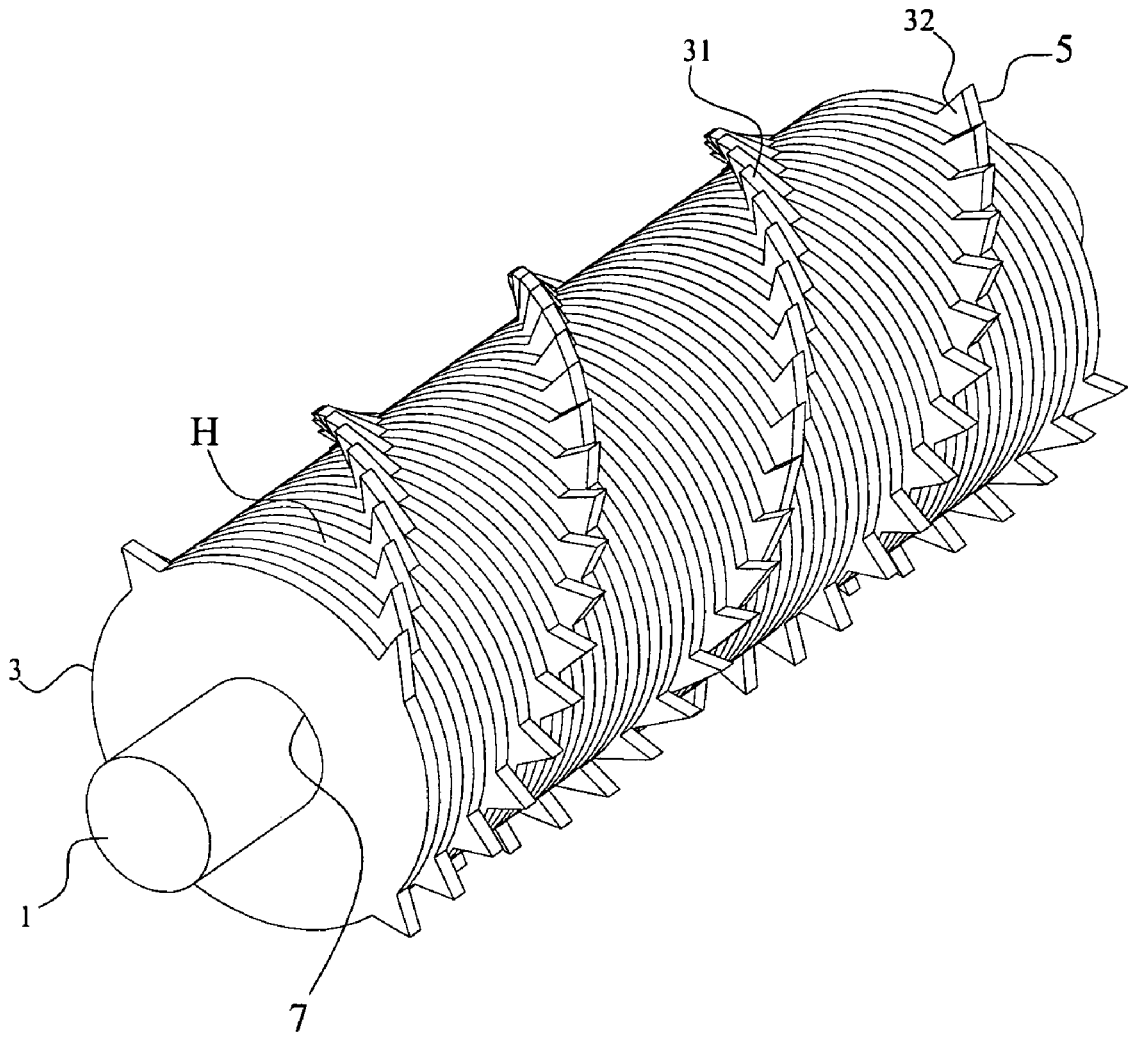
FIG. 2 is a perspective view of a left roller of the first preferred embodiment of the present invention.
Figure 3:
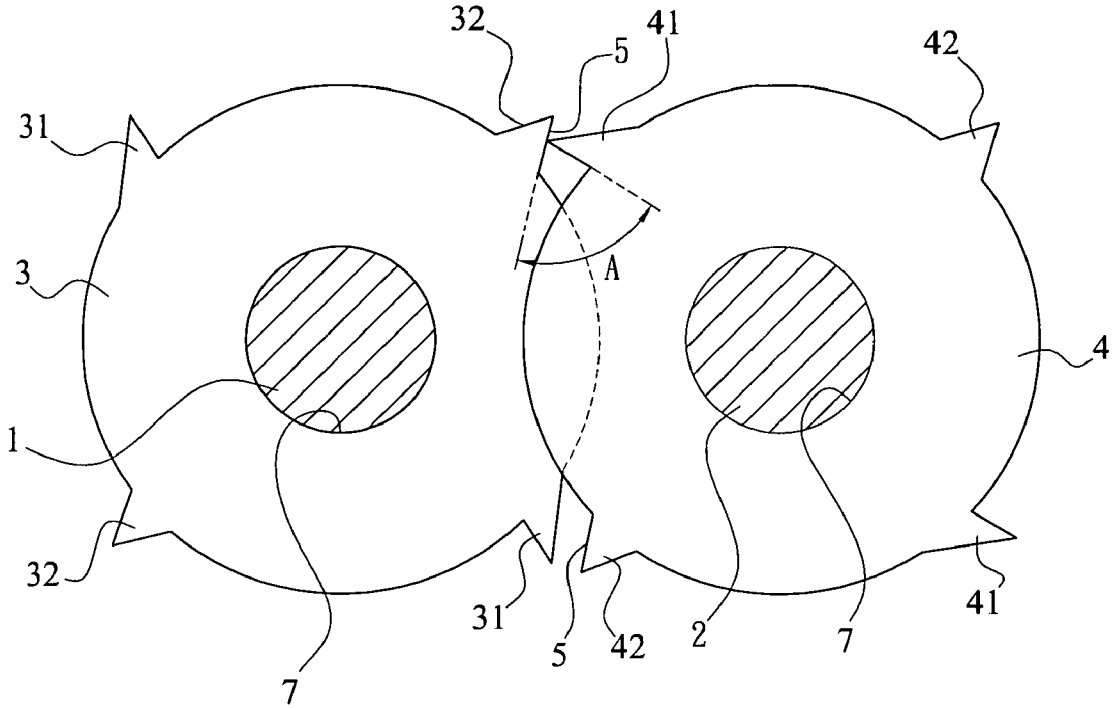
FIG. 3 is an illustrative view of the first embodiment of the present invention.

As shown in FIGS. 2 and 3, a paper shredding roller assembly comprises of a left roller (1), a right roller (2) provided at a lateral side of said left roller (1), a plurality of left circular knives (3) are attached axially to said left roller (1) in a spiral fashion, and spaced with each other by a predetermined distance (H), and a plurality of right circular knives (4) are attached axially to said right roller (2) in a spiral fashion, and spaced with each other by a predetermined distance (H). Pluralities of left cutting tips (31) are disposed around a circumference of the left circular knife (3) and pluralities of right cutting tips (41) are disposed around a circumference of the right circular knife (4). The claimed paper shredding roller assembly is characterized in that: each left circular knife (3) comprises of a plurality of sloping cutting edges (5) disposed around the circumference of said left circular knife (3), corresponding with the right cutting tips (41); and each right circular knife (4) comprises of a plurality of sloping cutting edges (5) disposed around the circumference of the right circular knife (4), corresponding with the left cutting tips (31).

Each left circular knife (3) includes a same quantity of cutting edges (5) and left cutting tips (31); and each right circular knife (4) includes a same quantity of cutting edges (5) and right cutting tips (41). For example, as shown in FIG. 3, two cutting edges (5) are provided respectively on said left and right blade (3, 4), therefore, two cutting tips (31, 41) are disposed onto the knives (3, 4) respectively. The quantity of the cutting edge (5) which can be provided on the knives (3, 4) is variable depending different requirement and not limited by having two.

Each left circular knife (3) comprises of pluralities of triangular projecting members (32) provided around the circumference there, and each projecting member (32) includes a said cutting edge (5) set on a lateral side thereof. The right roller (2) has the same structure, plurality of triangular projecting members (42) are provided around the circumference of the right circular knife (4) with each projecting member (42) has a said cutting edge (5) set on a lateral side thereof. The cutting edge (5) can be a straight or curved shape, when the present invention functions as the paper shredding roller unit, both rollers (1, 2) rotate in different directions (one clockwise and another counterclockwise) and the cutting tips (31, 41) of each roller and the sloping cutting edges (5) of another roller, as shown in FIG. 3, the right cutting tip (41) crossing the cutting edge (5) of projecting member (32) of the left circular knife (3), forming a cutting angle (A) approximate to a perpendicular angle, reducing rotary moment for the unit to shred the paper and energy consumption, which allows the unit function more efficiently.

Said left roller (1) and left circular knives (3), said right roller (2) and right circular knives (4) are allowed to be manufactured individually and assembled afterward. Each left and right circular knife (3, 4) has an axial hole (7) sized for receiving said left and right roller (1, 2). By engaging circular knives (3, 4) with the rollers (1, 2), it simplifies the manufacture procedure, reduces the cost for manufacture and future maintenance as well.

Even though the cost can be lowered by having knives (3, 4) and rollers (1, 2) made individually, slide or offset of the knife will occur after shredding paper for a period of time, which may decrease efficiency of the shredding unit. Therefore, said left and right roller (1, 2), left and right circular knives (3, 4) can also be manufactured integrally for strengthen the shredding roller unit in overall.

Second Embodiment

Figure 4:
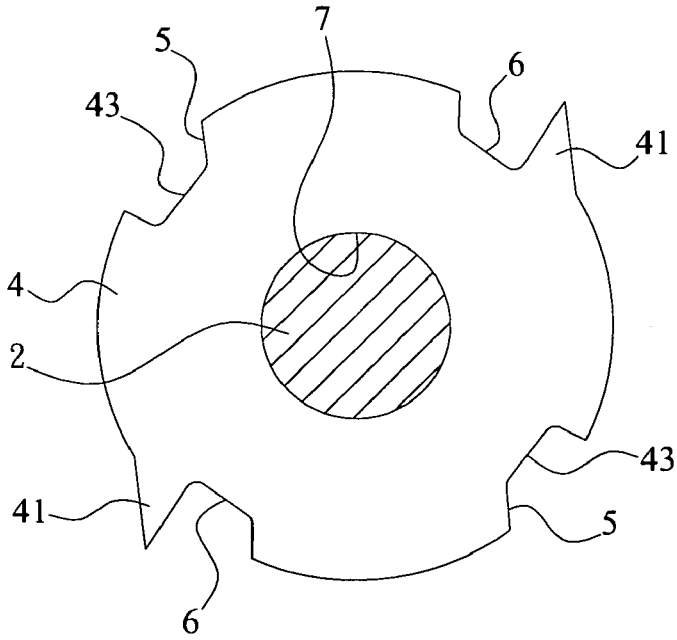
FIG. 4 is an illustration of the right roller of the second preferred embodiment of the present invention.
Figure 5:
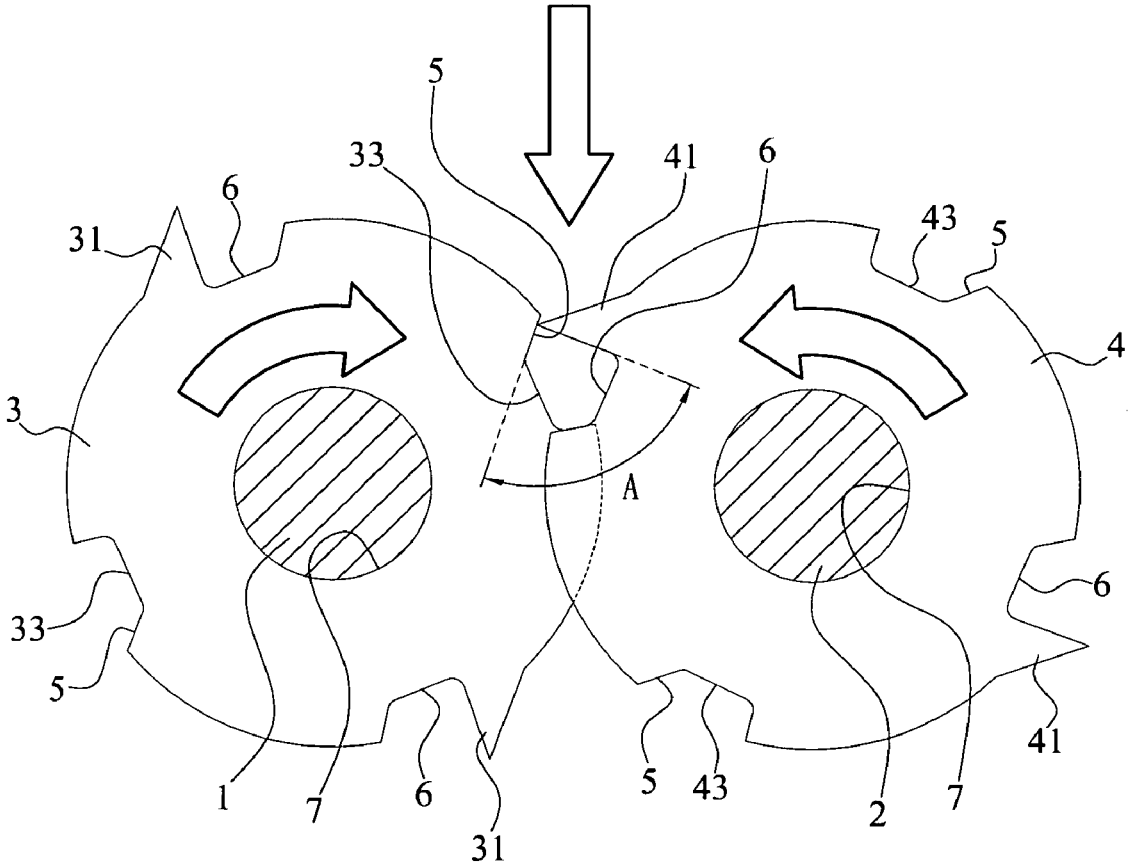
FIG. 5 is an illustrative view of the second embodiment of the present invention.

Referring to FIGS. 4 and 5, the second preferred embodiment of the present invention discloses another type left and right circular knife (3, 4) in which a plurality of left cutting grooves (33) are provided around the circumference of the left circular knife (3), and each left cutting groove (33) has a said cutting edge (5) set on a lateral side thereof; and a plurality of right cutting grooves (43) are provided around the circumference of the right circular knife (4), and each right cutting groove (43) has a said cutting edge (5) set on a lateral side thereof. Similar to the first embodiment, the cutting grooves (33, 44) of each roller interact with the sloping cutting edges (5) of another roller, as shown in FIG. 5, the right cutting tip (41) crossing the cutting edge (5) of cutting groove (33) of the left circular knife (3), forming a cutting angle (A) even more approximate to a perpendicular angle than the angle (A) of the first embodiment, which improving further the efficiency of the unit.

Since the left and right cutting tips (31, 41) interact with cutting grooves (33, 43) to shred the paper, paper fragment may fall and reside at the bottom of cutting grooves (33, 43) instead of collecting by the basket (not shown) which is provided under the paper shredding unit. The fragments accumulated in the cutting grooves (33, 43) increase the load of both rollers (1, 2) and reducing the cutting ability of the unit.

In order to allow paper fragments not accumulating in the cutting grooves (33, 43), a recessed portion (6) is set close to a bottom of each left and right cutting tip (31, 41) respectively, thus a bigger opening is formed between the left and right rollers (1, 2) allowing shredded paper fall down to the basket.

The invention claimed is:

1. A paper shredding roller assembly comprises of:

a left roller (1);

a right roller (2) juxtaposed to said left roller (1);

a plurality of left circular knives (3) are attached axially to said left roller (1) in a spiral fashion, and spaced with each other by a predetermined distance (H); and a plurality of right circular knives (4) are attached axially to said right roller (2) in a spiral fashion, and spaced with each other by a predetermined distance (H);

a plurality of left cutting tips (31) are disposed around a circumference of the left circular knife (3);

a plurality of right cutting tips (41) are disposed around a circumference of the right circular knife (4); and characterized in that: each left circular knife (3) comprises of a plurality of sloping cutting edges (5) disposed around the circumference of said left circular knife (3), corresponding with the right cutting tips (41); and each right circular knife (4) comprises of a plurality of sloping cutting edges (5) disposed around the circumference of the right circular knife (4), corresponding with the left cutting tips (31).

2. The paper shredding roller assembly of claim 1, wherein each left circular knife (3) includes a same quantity of cutting edges (5) and left cutting tips (31); and each right circular knife (4) includes a same quantity of cutting edges (5) and right cutting tips (41).

3. The paper shredding roller assembly of claim 1, wherein a plurality of triangular projecting members (32) are provided around the circumference of the left circular knife (3), and each projecting member (32) has a said cutting edge (5) set on a lateral side thereof; a plurality of triangular projecting members (42) are provided around the circumference of the right circular knife (4), and each projecting member (42) has a said cutting edge (5) set on a lateral side thereof.

4. The paper shredding roller assembly of claim 1, wherein a plurality of cutting grooves (33) are provided around the circumference of the left circular knife (3), and each has a said cutting edge (5) set on a lateral side thereof; a plurality of cutting grooves (43) are provided around the circumference of the right circular knife (4), and each has a said cutting edge (5) set on a lateral side thereof.

5. The paper shredding roller assembly of claim 1, wherein a recessed portion (6) is set respectively close to a bottom of each left and right cutting tip (31, 41).

6. The paper shredding roller assembly of claim 1, wherein said left roller (1) and left circular knives (3), said right roller (2) and right circular knives (4) are manufactured individually; each left and right circular knife (3, 4) has an axial hole (7) sized for receiving said left and right roller (1, 2).

7. The paper shredding roller assembly of claim 1, wherein said left roller (1) and left circular knives (3) are manufactured integrally; and said right roller (2) and right circular knives (4) are manufactured integrally.

* * * * *